US009537260B1

(12) United States Patent
Chen et al.

(10) Patent No.: US 9,537,260 B1
(45) Date of Patent: Jan. 3, 2017

(54) POWER DISTRIBUTOR WITH MODULAR COVER UNITS AND A SLIDABLE HANGING MECHANISM

(71) Applicant: Fuzhou Six Sights Electro-Mech Co. Ltd., Fuzhou (CN)

(72) Inventors: Liang Light Chen, Los Gatos, CA (US); Jie Mo, Fuzhou (CN); Zhecai Dong, Fuzhou (CN); Zhenguo Wu, Fuzhou (CN)

(73) Assignee: Fuzhou Six Sights Electro-Mech Co. Ltd., Fuzhou (CN)

( * ) Notice: Subject to any disclaimer, the term of this patent is extended or adjusted under 35 U.S.C. 154(b) by 0 days.

(21) Appl. No.: 15/099,107

(22) Filed: Apr. 14, 2016

(30) Foreign Application Priority Data

Sep. 8, 2015 (CN) ..... 201510564207

(51) Int. Cl.
*H01R 25/00* (2006.01)
*H01R 13/639* (2006.01)
*H01R 13/518* (2006.01)
*H01R 24/76* (2011.01)

(52) U.S. Cl.
CPC ..... *H01R 13/6395* (2013.01); *H01R 13/518* (2013.01); *H01R 24/76* (2013.01); *H01R 25/00* (2013.01); *H01R 25/003* (2013.01)

(58) Field of Classification Search
CPC ..... H01R 13/518; H01R 13/659; H01R 24/00; H01R 24/78; H01R 24/525; H01R 25/00; H01R 27/02; H01R 31/00; H01R 31/06; H01R 33/00; H01R 33/88
USPC ..... 439/540.1, 538, 541, 652, 653
See application file for complete search history.

(56) References Cited

U.S. PATENT DOCUMENTS 4,930,047 A * 5/1990 Peterson ..... H01R 25/003 200/51 R
5,073,120 A * 12/1991 Lincoln ..... H01R 31/02 439/215
5,334,033 A * 8/1994 Milan ..... H01R 13/6666 439/214
6,755,676 B2 * 6/2004 Milan ..... H01R 25/003 439/214
7,347,734 B1 * 3/2008 Teitelbaum ..... H01R 25/00 439/652
7,893,567 B1 * 2/2011 Deros ..... H02G 3/0431 307/147
8,585,444 B2 * 11/2013 Chang ..... H01R 13/627 439/131
9,281,644 B2 * 3/2016 Myong ..... H01R 25/003
2006/0117684 A1 * 6/2006 Picard ..... H02G 3/00 52/239

(Continued)

*Primary Examiner* — Chandrika Prasad
(74) *Attorney, Agent, or Firm* — Douglas L. Weller

(57) ABSTRACT

A power distributor includes an upper cover with an inverted U-shaped cross-section, a plurality of output power sockets being located along a longitudinal direction of the upper cover. The power distributor also includes a lower cover with a U-shaped cross-section. The lower cover is engaged with the upper cover to form housing for the power distributor. The upper cover is composed of several modular cover units that are interconnected with each other. Each modular cover unit includes stepped connecting parts that connect to stepped connecting parts of adjacent modular cover units. The lower cover includes a slidable hanging mechanism. A front end of the housing is provided with an input power connector.

11 Claims, 14 Drawing Sheets

(56) References Cited

U.S. PATENT DOCUMENTS

2012/0295483 A1* 11/2012 Smed ..... H01R 9/2408
439/620.21

* cited by examiner

POWER DISTRIBUTOR WITH MODULAR COVER UNITS AND A SLIDABLE HANGING MECHANISM

BACKGROUND

A power distributor, such as a power distribution unit (PDU), is often used to provide power distribution for electrical equipment within a cabinet. Housing for power distributors typically include an upper cover and a lower cover. The output power socket is usually centrally installed on the upper cover.

DESCRIPTION OF THE EMBODIMENT

A power distributor includes an upper cover with an inverted U-shaped cross-section, a plurality of output power sockets being located along a longitudinal direction of the upper cover. The power distributor also includes a lower cover with a U-shaped cross-section. The lower cover is engaged with the upper cover to form housing for the power distributor. The upper cover is composed of several modular cover units that are interconnected with each other. Each modular cover unit includes stepped connecting parts that connect to stepped connecting parts of adjacent modular cover units. The lower cover includes a slidable hanging mechanism. A front end of the housing is provided with an input power connector.

The structure of the power distributor is conducive to rapid assembly. In addition, the modular nature is conducive to using standardized parts on the upper cover of the power distributor. Additionally, the modular structure of the power distributor is compact and the power distributor can be quickly connected to a cabinet by the slidable hanging mechanism. It is also easily adjustable once connected.

Figure 1:
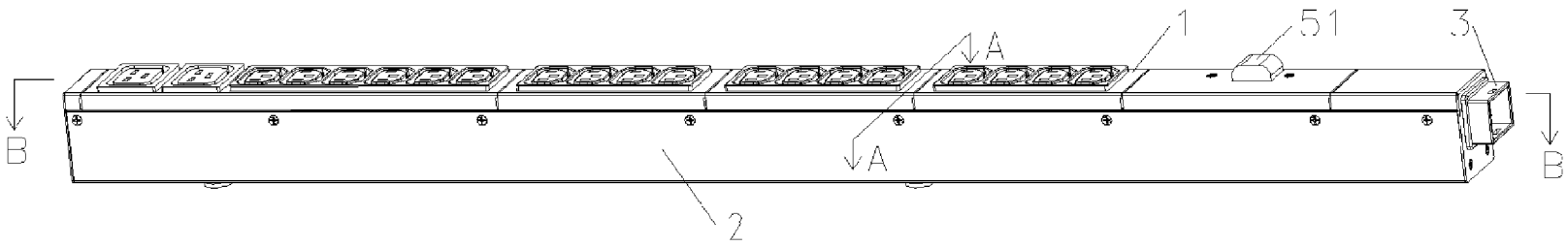
FIG. 1 shows a modular structure for a power distributor in accordance with an implementation.

A first implementation of a power distributor is shown in FIGS. 1 through 9. FIG. 1 shows a modular structure of a power distributor that includes an upper cover 1 with an inverted U-shaped cross-section. A plurality of output power sockets 11 are located along the longitudinal direction of upper cover 1. A lower cover 2, with U-shaped cross-section, is engaged with upper cover 1 to form the housing of the power distributor.

Figure 7:
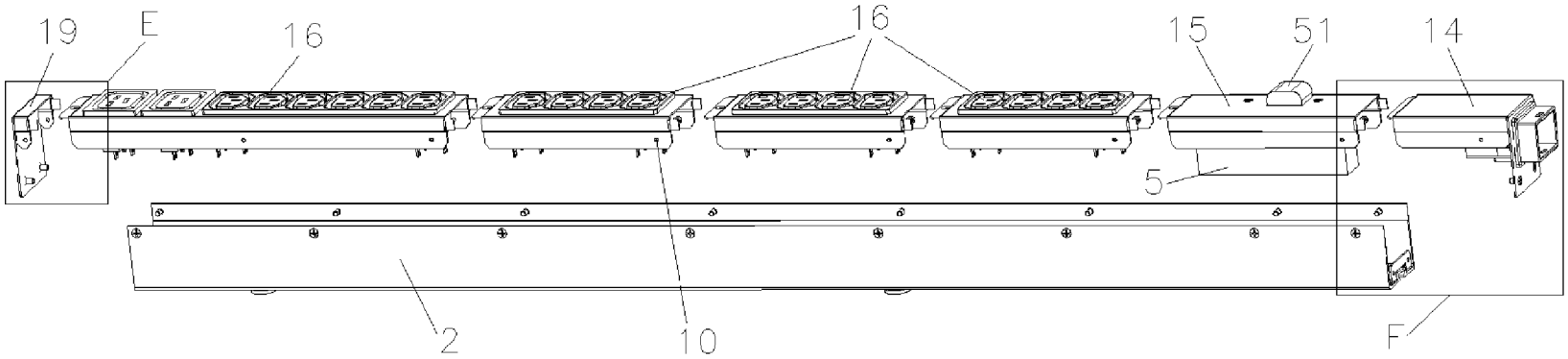
FIG. 7 is an exploded state view of a modular structure for a power distributor in accordance with an implementation.

Upper cover 1 is composed of several modular cover units that are interconnected with each other. Upper cover 1 can be variously configured. For example, FIG. 7 shows upper cover 1 including a power input cover 14, a circuit protection cover 15, socket covers 16 and a rear cover 19. Alternatively, upper cover 1 might be configured to additionally or alternatively include a display cover, a communications cover and so on.

Figure 6:
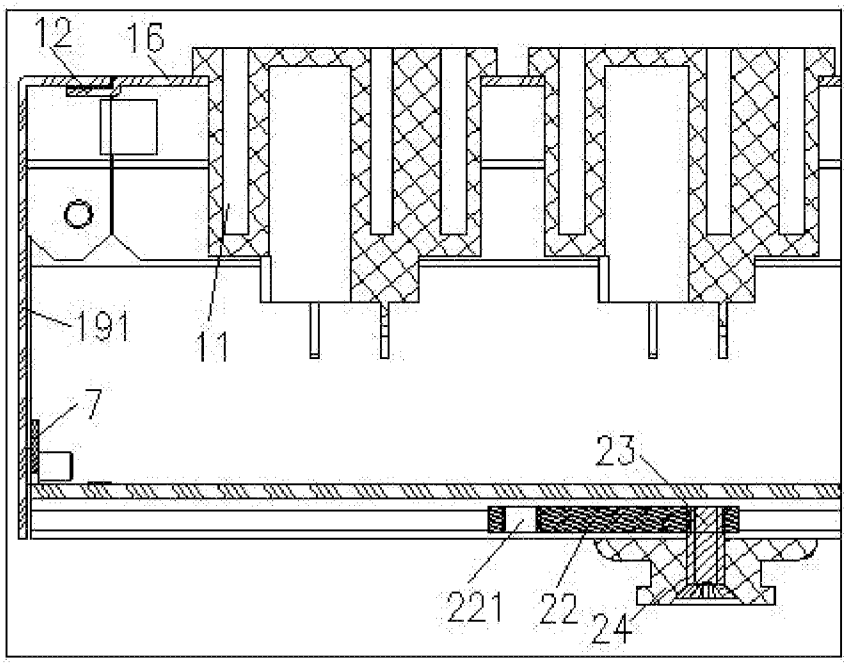
FIG. 6 is an enlarged view of intra-area D of FIG. 3 in accordance with an implementation.
Figure 8:
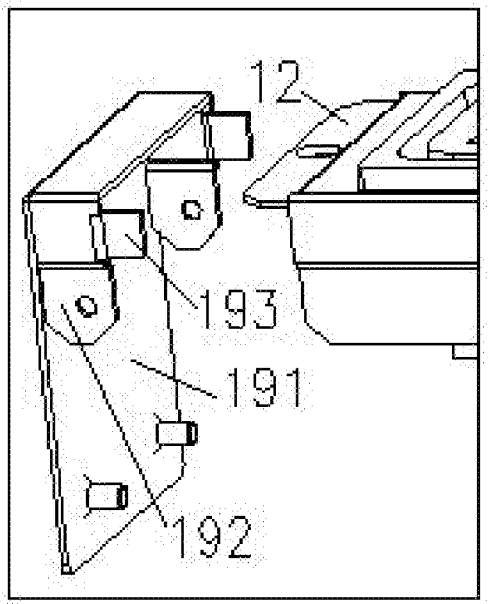
FIG. 8 is an enlarged view of intra-area E of FIG. 7 in accordance with an implementation.
Figure 9:
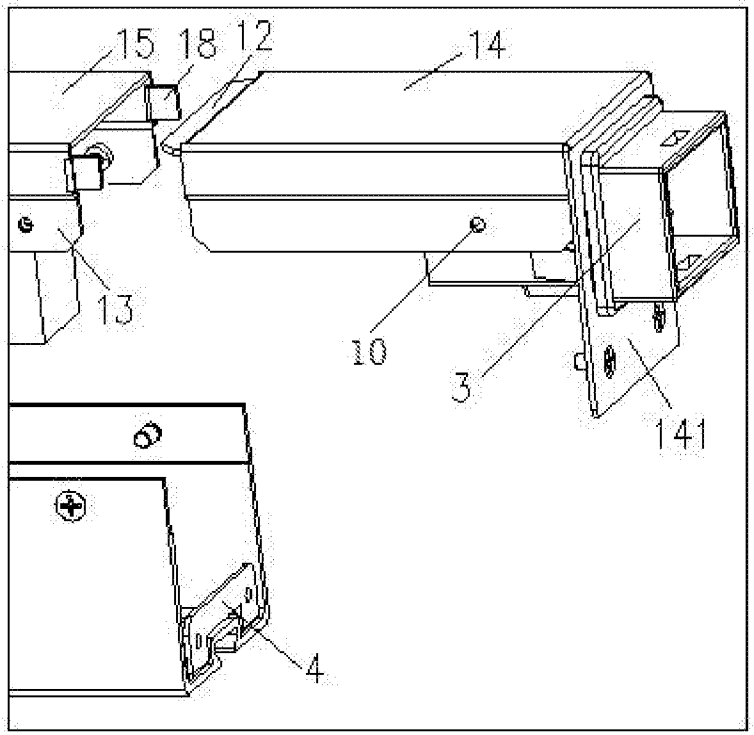
FIG. 9 is an enlarged view of intra-area F of FIG. 7 in accordance with an implementation.

As shown in FIGS. 6, 8 and 9, on the back of the roof of the modular cover units is disposed a stepped connecting part 12 for insertion into the inside of the front end of the adjacent modular cover units. Vertical plates on both sides of the modular cover units are respectively provided with an inner stepped connecting part 13 to join with the two sides plates of lower cover 2. Lower cover 2 has U-shaped cross-section is arranged with a slidable hanging mechanism. At the front end of the housing is provided an input power connector 3, as shown in FIG. 1.

FIG. 7 shows a breaker 5 mounted on circuit protection cover 15. A button 51 of breaker 5 passes through the top plate of circuit protection cover 15. Circuit protection cover 15 is an example of a multifunction cover. These multifunction covers are all one size, but can have a different function.

As shown in FIG. 7, the length of each of socket covers 16 is a multiple of the length of circuit protection cover 15. This allows for easy replacement of socket covers 16 and the multifunction covers. This also facilitates insertion and removal of modules as required for modular power distributor.

Figure 2:
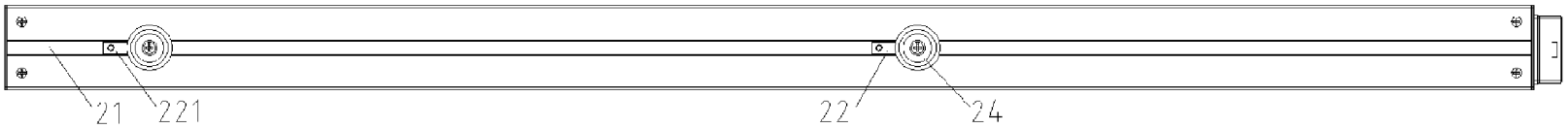
FIG. 2 is a bottom view of a modular structure for a power distributor in accordance with an implementation.
Figure 3:
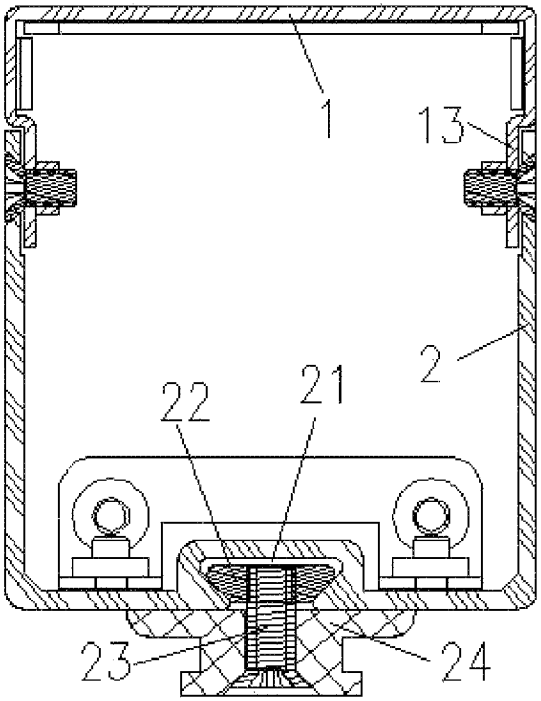
FIG. 3 is a cutaway view of A-A of FIG. 1 in accordance with an implementation.

FIG. 2 shows slidable hanging mechanism that includes a sliding groove 21. Sliding groove 21 is located on the base plate of lower cover 2. Sliding groove 21 is provided with at least two sliders 22 that join with sliding groove 21. At one end of sliders 22 are positioned bolt holes 221 for locking. Sliding sleeve 24 has an I-shaped cross-section for hanging. As shown in FIG. 3, sliding sleeve 24 is detachably connected to slider 22 by bolts 23. Sliding groove 21 is used to hang to the connecting holes located on the side walls of the cabinet so that the power distribution can be more efficient and convenient connected with the cabinet.

Figure 4:
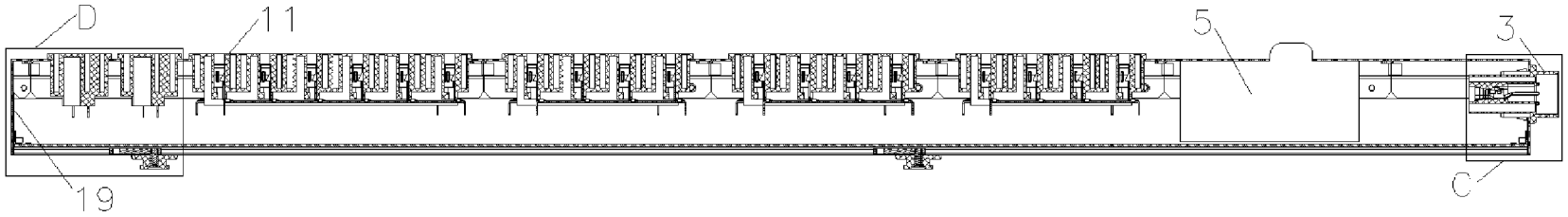
FIG. 4 is a cutaway view of B-B of FIG. 1 in accordance with an implementation.

As shown in FIG. 4, output power sockets 11 are arranged side by side on socket covers 16.

Figure 5:
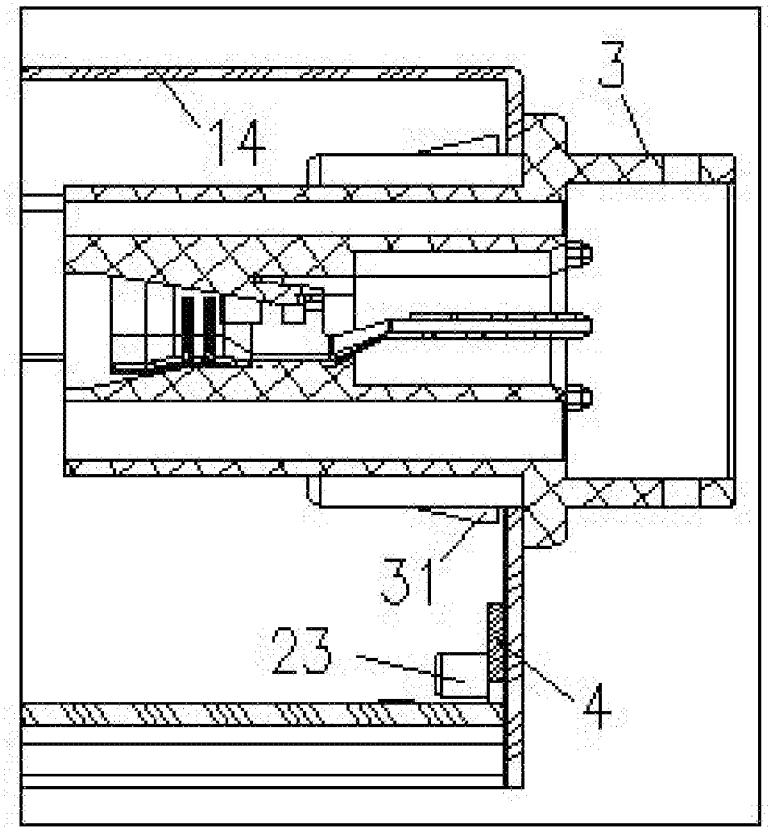
FIG. 5 is an enlarged view of intra-area C of FIG. 3 in accordance with an implementation.

As shown by FIG. 5 and FIG. 9, the front end of power input cover 14 is provided with a front cover plate 141. The input power connector 3 is embedded into front cover plate 141 by the convex part 31 disposed on the input power connector 3. The lower end of front cover plate 141 is connected to a rounded connection 4 mounted on front end of the baseboard of lower cover 2 by bolts. Stepped connecting part 12 of front cover plate 141 is connected to one of socket covers 16 or a multifunction cover.

As shown in FIG. 9, at the front end of both sides vertical plates of socket covers 16 and the multifunction cover are respectively arranged a forward convex linking plate 18 for interconnecting with socket covers 16, the multifunction cover and power input cover 14. In order to achieve the two adjacent modular cover units tightly interconnected, the upper surface of forward convex linking plate 18 is pressed against the under surface of stepped connecting part 12 of adjacent socket covers 16, a multifunction cover or power input cover 14.

As shown in FIGS. 6 and 8, rear cover 19 is provided with a rear cover plate 191 for covering the rear end of the housing. The lower end of rear cover plate 191 is connected to a second rounded connection 6 mounted on the rear end of the baseboard of lower cover 2 by bolts. The bottom of the both sides of the vertical plates of the rear cover are respectively provided with a second inner stepped connecting part 192 to engage with the both sides plates of lower cover 2. The front end of both sides vertical plates of the rear cover are respectively provided with a forward convex linking plate 193 for inserted into socket covers 16 and the multifunction cover located at the front of rear cover 19, in order to tightly join with socket covers 16 and the multifunction cover located at the front of rear cover 19 and achieve easy disassembly. The upper surface of forward convex linking plate 193 is pressed against the under surface of stepped connecting part 12 of socket covers 16 and the multifunction cover located at the front of rear cover 19. A clip 7 is also shown in FIG. 6.

Figure 14:
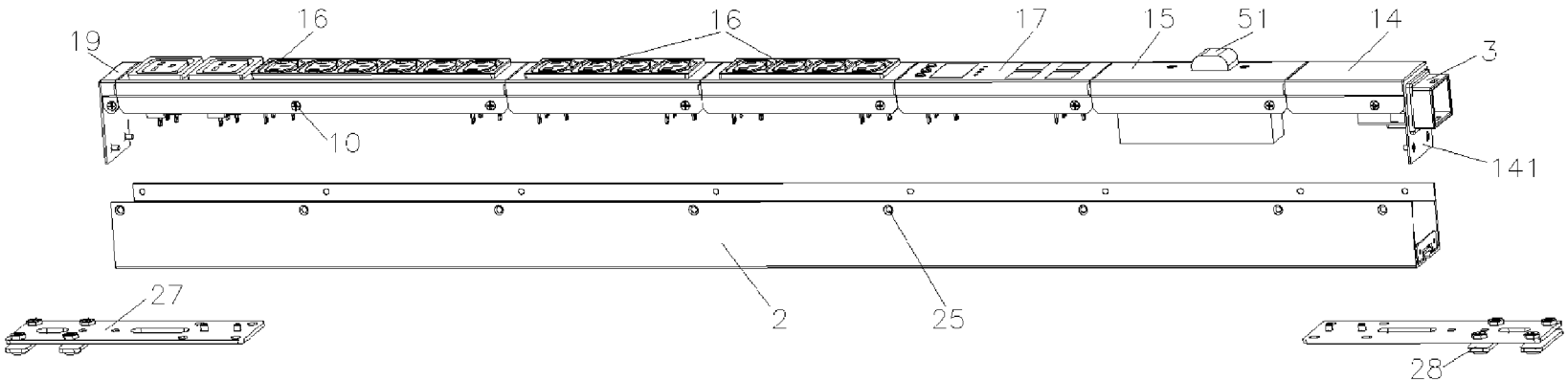
FIG. 14 is an exploded state view of the modular structure shown in FIG. 12 in accordance with the third implementation.

The upper of both sides plates of lower cover 2 are respectively provided with bolt holes 25 at intervals and along the longitudinal direction of the lower cover, as illustrated in FIG. 14. Bolt holes 25 respectively correspond to threaded holes 10 disposed in the inner stepped connecting part 13 of the modular cover units. The modular cover units are combined with lower cover 2 by inner stepped connecting part 13 with one or more of threaded holes 10.

Figure 10:
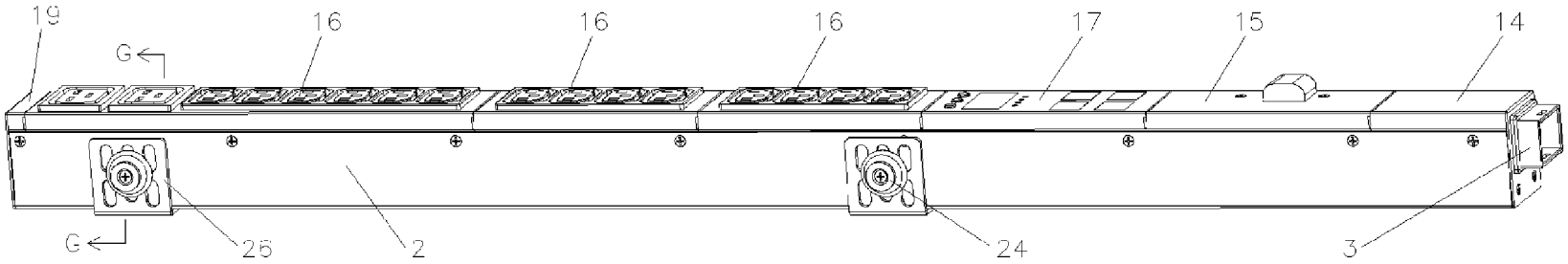
FIG. 10 shows a modular structure for a power distributor in accordance with a second implementation.
Figure 11:
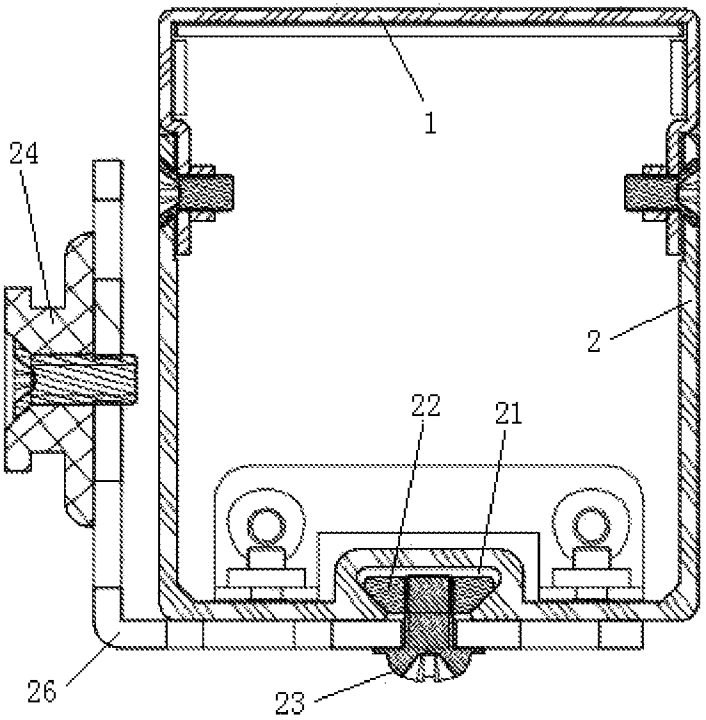
FIG. 11 is a cutaway view of G-G of FIG. 10 in accordance with an implementation.

A second implementation is shown in FIGS. 10-11. In this implementation, upper cover 1 includes a power input cover 14, a circuit protection cover 15, an intelligent control cover 17, socket covers 16 and a rear cover 19. Alternatively, upper cover 1 might be configured to additionally or alternatively include a display cover, a communications cover or some other multifunction cover or combinations of multifunction covers.

In a second implementation, as shown by FIG. 11, the slidable hanging mechanism is a side-hanging structure that includes sliding groove 21, which is arranged on the base plate of lower cover 2. Sliding groove 21 is provided with at least two sliders 22 that slide along sliding groove 21. Sliders 22 through bolts 23 are detachably connected to a crooked plate 26 which turns off one side of the housing. The crooked portion of crooked plate 26 is located on the side of the housing and is connected to the sliding sleeve 24 with I-shaped cross-section for hanging by bolts. The suspension mechanism can be adjustable according to the position of the connecting holes located on the side walls of the cabinet, so that the connection between the power distributor and the cabinet is more convenient.

Figure 12:
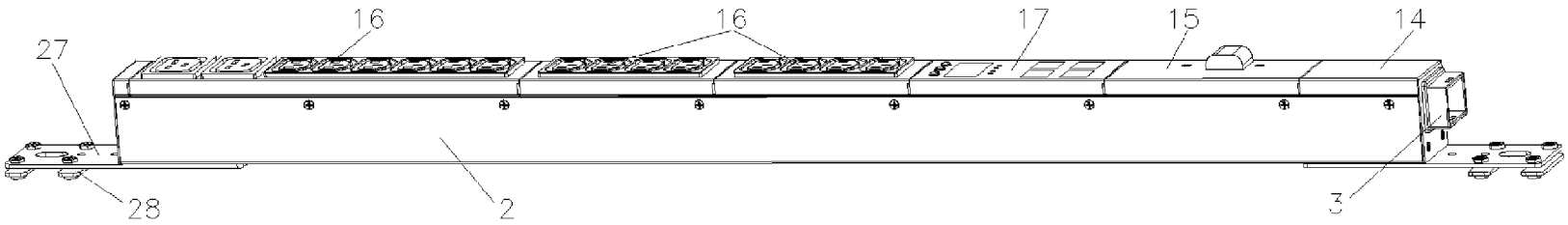
FIG. 12 shows of a modular structure for a power distributor in accordance with a third implementation.
Figure 13:
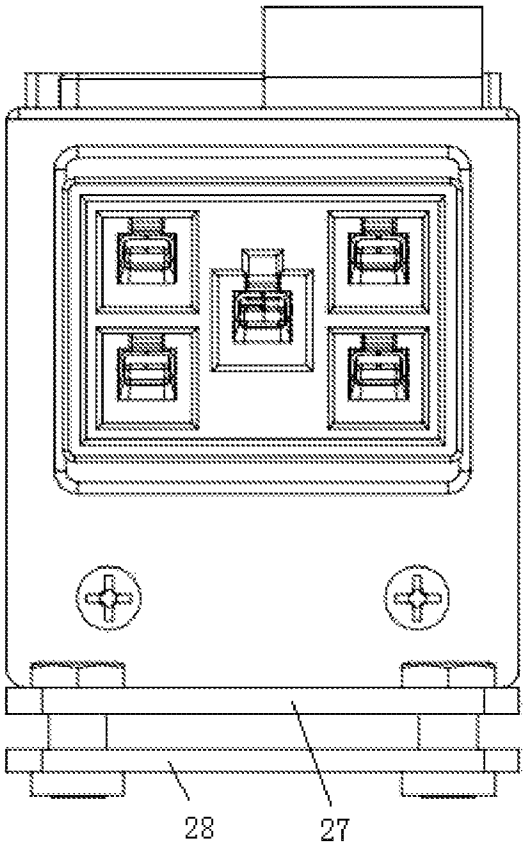
FIG. 13 is a side elevation view of the modular structure shown in FIG. 12 in accordance with the third implementation.

A third implementation is shown in FIGS. 12-14. In this implementation, upper cover 1 includes a power input cover 14, a circuit protection cover 15, an intelligent control cover 17, socket covers 16 and a rear cover 19. Alternatively, upper cover 1 might be configured to additionally or alternatively include a display cover, a communications cover or some other multifunction cover or combinations of multifunction covers.

In the third implementation, the slidable hanging mechanism is a straight-hanging structure. Sliding groove 21 is arranged on the base plate of lower cover 2. Sliding groove 21 is provided with at least two sliders 22 joining with sliding groove 21. A longitudinal plate 27 is fixed on sliders 22 and located on the downside of lower cover 1 along the longitudinal direction of the housing. Each end of lower cover 2 includes a longitudinal plate 27. Each longitudinal plate 27 stretching out of the housing is provided a lateral plate 28. Both ends of lateral plates 28 are hung on the downside of the longitudinal plate 27 by bolts. The suspension mechanism can be adjustable according to the position of the connecting holes located on the side walls of the cabinet, so that the connection between the power distributor and the cabinet is more convenient.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A power distributor, comprising:

an upper cover with an inverted U-shaped cross-section, a plurality of output power sockets being located along a longitudinal direction of the upper cover; and, a lower cover with a U-shaped cross-section, the lower cover being engaged with the upper cover to form housing for the power distributor;

wherein the upper cover is composed of several modular cover units that are interconnected with each other, each modular cover unit including stepped connecting parts that connect to stepped connecting parts of adjacent modular cover units;

wherein the lower cover includes a slidable hanging mechanism.

2. A power distributor as in claim 1, wherein the modular cover units are a combination of a power input cover, socket covers and multifunction covers and a rear cover, wherein each multifunction cover is one of the following:

a circuit protection cover;

a display cover;

a communications cover;

an intelligent control cover.

3. A power distributor as in claim 1, wherein the upper cover includes a power input cover, a plurality of socket covers, a multifunction cover and a rear cover, wherein output power sockets are arranged side by side on the socket covers.

4. A power distributor as in claim 2, wherein a length of each socket cover is a multiple of the length of the multifunction cover.

5. A power distributor as in claim 1, wherein the slidable hanging mechanism comprises:

a sliding groove on a base plate of the lower cover, where at least two sliders join with the sliding groove, a sliding sleeve with I-shaped cross-section for hanging being detachably connected to each slider by bolts.

6. A power distributor as in claim 1, wherein the slidable hanging mechanism comprises a sliding groove, which is arranged on a base plate of the lower cover, the sliding groove is provided with at least two sliders joining with the sliding groove, a longitudinal plate is fixed on the sliders and located on a downside of the lower cover along a longitudinal direction of the housing, an end of a longitudinal plate stretching out of the housing being provided with lateral plates, both ends of the lateral plates being hung on a downside of the longitudinal plate by bolts.

7. A power distributor as in claim 1 wherein one of the modular covers is a power input cover and wherein a front end of the power input cover is provided with a front cover plate, and an input power connector is embedded into the front cover plate, and a lower end of the front cover plate is connected to a rounded connection mounted on a front end of a baseboard of the lower cover by bolts, a stepped connecting part of the front cover plate being connected to a socket cover or a multifunction cover.

8. A power distributor as in claim 2 wherein at a front end of both sides of vertical plates of the modular cover units there is respectively arranged, a forward convex linking plate for interconnecting with other modular cover units, the forward convex linking plate being attached to an inner side of a vertical plate.

9. A power distributor as in claim 1:

wherein a rear cover is provided with a rear cover plate for covering a rear end of the housing, and a lower end of the rear cover plate is connected to a second rounded connection mounted on a rear end of a baseboard of the lower cover by bolts, and a bottom of vertical plates of the rear cover are respectively provided with a second inner stepped connecting part to engage with two sides plates of the lower cover; and, wherein a front end of two side vertical plates of the rear cover are respectively provided with a forward convex linking plate for insertion into socket covers and the multifunction cover located at a front of the rear cover.

10. A power distributor as in claim 1, wherein an upper of portion of two side plates of the lower cover are respectively provided with bolt holes at intervals and along a longitudinal direction of the lower cover;

wherein bolt holes are respectively corresponded to threaded holes located in an inner stepped connecting part of the modular cover units; and, wherein the modular cover units are combined with the lower cover by the inner stepped connecting parts with one or more of threaded holes.

11. A power distributor as in claim 1, wherein the slidable hanging mechanism comprises:

a sliding groove on a base plate of the lower cover, where at least two sliders join with the sliding groove, a sliding sleeve with I-shaped cross-section for hanging being detachably connected to a crooked plate off one side of the housing, a crooked portion of the crooked plate being located on a side of the housing that is connected to the sliding sleeve.

* * * * *